US008931411B2

(12) United States Patent
Schnabel et al.

(10) Patent No.: US 8,931,411 B2
(45) Date of Patent: Jan. 13, 2015

(54) METHOD FOR REGULATING A WEB TENSION IN A PROCESSING MACHINE

(71) Applicant: Robert Bosch GmbH, Stuttgart (DE)

(72) Inventors: Holger Schnabel, Wuerzburg (DE); Stephan Schultze, Lohr-Wombach (DE); Mario Goeb, Wuerzburg (DE)

(73) Assignee: Robert Bosch GmbH, Stuttgart (DE)

( * ) Notice: Subject to any disclaimer, the term of this patent is extended or adjusted under 35 U.S.C. 154(b) by 32 days.

(21) Appl. No.: 13/730,166

(22) Filed: Dec. 28, 2012

(65) Prior Publication Data

US 2013/0167744 A1 Jul. 4, 2013

(30) Foreign Application Priority Data

Dec. 29, 2011 (DE) ..... 10 2011 122 514
Feb. 10, 2012 (DE) ..... 10 2012 002 724

(51) Int. Cl.
*B41L 17/22* (2006.01)
*B65H 23/18* (2006.01)
B65H 23/00 (2006.01)
*B65H 23/188* (2006.01)

(52) U.S. Cl.
CPC ..... *B65H 23/00* (2013.01); *B65H 23/1888* (2013.01); *B65H 2513/11* (2013.01); *B65H 2515/31* (2013.01); *B65H 2557/264* (2013.01); *B65H 2801/21* (2013.01); *Y10S 101/42* (2013.01)
USPC ..... 101/484; 101/DIG. 42; 101/219; 101/228; 101/485; 226/24

(58) Field of Classification Search
CPC ..... B65H 23/1888; B65H 2557/264; B65H 2557/2644
USPC ..... 101/219, 228, DIG. 42; 226/2, 24, 28, 226/42; 242/417.3; 700/122
See application file for complete search history.

(56) References Cited

U.S. PATENT DOCUMENTS

2011/0137451 A1* 6/2011 Schultze et al. ..... 700/213

FOREIGN PATENT DOCUMENTS

DE 10 2005 058 810 A1 6/2007
DE 10 2008 053 406 A1 4/2010

(Continued)

OTHER PUBLICATIONS

German Search Report corresponding to German Patent Application No. DE 10 2012 002 724.9, dated Jan. 21, 2013 (5 pages).

(Continued)

*Primary Examiner* — Ren Yan
*Assistant Examiner* — Justin Olamit
(74) *Attorney, Agent, or Firm* — Maginot, Moore & Beck LLP

(57) ABSTRACT

A method for regulating a web tension in a processing machine for processing a product web, in particular a shaftless printing press, includes separating a first product-web section from a second product-web section by a delay section. The web tensions in the first and second product-web sections are influenced by first and second actuators, respectively. To regulate the web tension in the first product-web section, the method further includes defining a regulation output value from which an actuating command for the first actuator is derived. An actuating command for the second actuator is defined from the regulation output value and a delay element to decouple the web tension in the second product-web section from the regulation of the web tension in the first product-web section. The delay element delays the effect of the regulation output value on the actuating command for the second actuator by a delay time.

11 Claims, 3 Drawing Sheets

(56) References Cited

FOREIGN PATENT DOCUMENTS

| | | | |
|---|---|---|---|
| DE | 10 2008 056 132 | A1 | 5/2010 |
| DE | 10 2010 009 402 | A1 | 9/2010 |
| DE | 10 2009 016 206 | A1 | 10/2010 |
| DE | 10 2009 026 987 | A1 | 8/2011 |
| DE | 10 2011 014 074 | A1 | 2/2012 |

OTHER PUBLICATIONS

Brandenburg, Günther et al., "Schnittregister—und Bahnzugkraftregelung im Illustrationsdruck," A&D Kompendium, 2005, pp. 274-278.

Brandenburg, Günter, "Über das dynamische Verhalten durchlaufender elastischer Stoffbahnen bei Kraftübertragung durch Coulomb'sche Reibung in einem Stoffsystem angetriebener, umschlungener Walzen," Dissertation, 1971, Technische Universität München.

Brandenburg, Günter, "Über das dynamische Verhalten durchlaufender elastischer Stoffbahnen in einem System umschlungener Walzen," Zeitungstechnik, Sep. 1992, pp. 12-26, ISSN 0019-333X.

Schnabel, Holger et al., "Simulation und Optimierung des Bahnspannungsverhaltens," Bahnlaufseminar 9: Aktuelle Erkenntnisse aus Entwicklung und Forschung zum Thema Bahnlauf, Sep. 11-12, 2007, pp. 93-103.

* cited by examiner

METHOD FOR REGULATING A WEB TENSION IN A PROCESSING MACHINE

This application claims priority under 35 U.S.C. §119 to patent application no. DE 10 2011 122 514.9, filed on Dec. 29, 2011 in Germany, and to patent application no. DE 10 2012 002 724.9, filed on Feb. 10, 2012 in Germany, the disclosures of which are incorporated herein by reference in their entirety.

BACKGROUND

The present disclosure relates to a method for regulating a web tension in a processing machine.

Although the disclosure will be described in the following text substantially with reference to printing presses, it is not restricted to an application of this type, but rather can be used in all types of processing machines, in which a tension of a product web or material web is to be predefined. The product web can be configured from paper, material, cardboard, plastic, metal, rubber, in film form, etc.

In processing machines, in particular printing presses, a product web is moved along driven axles (web transport axles), such as pull rolls or feed rolls, and non-driven axles, such as deflecting, guiding, drying or cooling rolls. At the same time, the product web is processed by means of usually likewise driven processing axles, for example is printed, punched, cut, folded, etc.

The tension or web stress (as long as no cross-sectional change occurs, the tension and stress are proportional; however, the tension is usually measured) of the product web is influenced, for example, via what are known as clamping points which clamp the product web positively or non-positively. Here, these are regularly driven transporting or processing units. In a gravure printing press, a clamping point is usually formed by a printing unit, in which a frictional unit exists between the driven impression cylinder, the impression roller and the material web. The product web is divided into product-web sections, a product-web section being delimited by two clamping points. Further driven and/or non-driven axles can be arranged within a product-web section. The entire product web is often divided into a plurality of product-web sections, sometimes also with different setpoint tension values. In order to maintain the setpoint values, what is known as web stress regulation (web tension regulation) is usually used. The regulation of the web tension usually takes place via a strain as manipulated variable, by the rotational speed of the clamping points being influenced.

The regulation of the web tension of a product-web section can take place in different ways. Downstream means that the clamping point which delimits the product-web section downstream is adjusted, and upstream means that the clamping point which delimits the product-web section upstream is adjusted. In this simple embodiment, however, the web tension in preceding and/or following product-web sections is not decoupled by the actuating movement. Rather, the change in the web tension is transported through the machine so as to follow the product-web course and is to be adjusted in all following sections. In addition to this indirect disruption on account of the transport of the material web, a direct disruption on account of the actuating movement is to be found in the product-web section which adjoins the adjusted clamping point.

It is possible, in the case of downstream regulation, to pilot control all the following clamping points by means of (dynamic) downstream pilot control, in such a way that said following clamping points compensate directly for the effects of the preceding clamping point, that is to say the web tension does not change there. As a consequence, it is ensured that all the following web-tension regulators do not have to compensate for the disruptions of the actuating movement and of the coupling by the material web. This is described, for example, in the publication "Simulation and Optimierung des Bahnspannungsverhaltens" [Simulation and optimization of the web-stress behavior], 9th web running seminar of the Technical University of Chemnitz, Chemnitz, 2007, Schnabel, H., Dörsam, E., Schultze, S. The web tension in the following product-web sections is decoupled here from the regulation of the web stress in the preceding product-web section.

DE 10 2008 056 132 A1 proposes decoupling for upstream regulation, (dynamic) downstream pilot control by means of PT1 element being carried out in addition to (constant) upstream pilot control.

DE 10 2009 016 206 A1 discloses a method with decoupling which is implemented exclusively in the upstream direction. Here, a combination is disclosed comprising pilot control which is weighted in the upstream direction by a $DT_1$ element and pilot control, which is weighted by a negative $PT_1$ element, exclusively of the rear delimiting clamping point. The specifications "upstream of" and "downstream of" a clamping point or a product-web section relate to the transport direction of the product web, that is to say the product-web course.

However, machine configurations are then also possible, in which a web stress change from one product-web section is reflected only after a time delay in another product-web section, the region between the two sections being unregulated and being called a delay section in the following text. The time delay is also called dead time.

A delay section is formed, for example, if the product web wraps around one or more rolls, such as cooling or drying rolls, the web tension approximately not changing during the roll contact as a result of the snug fit of the web against the roll. No concrete solution is specified in the prior art for cases of this type.

SUMMARY

According to the disclosure, a method for regulating a web tension is proposed having the features of the disclosure. Advantageous refinements are the subject matter of the subclaims and of the following description.

The disclosure provides the possibility of decoupling the tension in a second product-web section from tension regulation in a first product-web section, even if the first and the second product-web section are separated by a delay section. The web tension is not changed within the delay section, that is to say a product-web cross section leaves the delay section with essentially the same web tension, with which it ran into the delay section. It is to be emphasized that there can nevertheless be different web tension values along the delay section, by the web tension varying at the inlet point. A delay section is formed, for example, if the product web wraps around one or more rolls, such as cooling or drying rolls or back-pressure cylinders. Rolls which are wrapped around are usually also relatively large, with the result that, even above a wrap-around amount of approximately 5%, the effects on the web stress behavior are so great that the disclosure leads to appreciable advantages. The greater the wrap-around degree, the clearer the difference of decoupling according to the disclosure from decoupling from the prior art. Above a wrap-around amount of 25%, no more decoupling can usually be brought about by way of conventional means. The disclosure is then particularly advantageous here.

The disclosure indicates a solution to take transport delays (dead times) into consideration in the case of regulation or in the case of decoupling (pilot control). Here, in the context of the disclosure, time delay elements which are proportional to the delay times are used in the pilot control of actuators. In the context of the disclosure, the actuating command for an actuator of a first product-web section is defined in the context of tension regulation from a regulation output value, for example by a PI regulator. This regulation output value is pilot-controlled for decoupling at actuators of other product-web sections via corresponding regulating elements, such as P elements or PT1 elements, as is known from the prior art which is cited at the outset. In order then to additionally ensure effective decoupling even beyond a delay section, portions of actuating commands for selected actuators of product-web sections which are separated by a delay section are temporally delayed correspondingly, the time delay being proportional to the delay time of the delay section.

The delay time can be defined as a quotient of the web length (that is to say, the length of the product web) of the delay section (for example, this is the length of a wrap-around amount of a roll or of a CI impression cylinder (common impression) and the web speed. This advantageously makes an adaptation of the time delay element to changed web speeds online during operation possible. A delay section can, in particular, also be formed by a plurality of rolls one behind another, for example for drying paper in papermaking machines. Said rolls are often driven identically and together form a delay section.

According to one advantageous development, the behavior of the web tensions in the product-web sections which are adjacent to the delay section is taken into consideration during the determination of the web length of a delay section which is formed by one or more rolls which are wrapped around. If namely, in the case of a roll which is wrapped around, the web tensions are different on both sides of the roll, part of the wrap-around is affected by slip (Euler-Eytelwein rope friction equation). On account of frictional effects over a web-transporting roll which is wrapped around, it can occur that it is not the entire wrap-around angle that is assumed as dead time or transport time of the web extension, but rather only a smaller amount of the wrap-around angle, since, in the case of different web tensions upstream and downstream of the wrap-around amount, part of the wrap-around amount is transported in a manner which is affected by slip and therefore is not taken into account as dead time in the transport of the extended web, but rather can be considered to be a virtual extension of the corresponding associated web section. The greater the force difference, the greater the region of slip. The length of the non-slipping region defines the length of the delay section and can be calculated according to the above-mentioned Euler-Eytelwein rope friction equation. The region with slip is to be added in a first approximation to the adjoining product-web section. If, for example, a somewhat lower web tension is assumed upstream of the wrap-around amount than downstream of the wrap-around amount, part of the wrap-around amount at the wrap-around beginning (as viewed in the web running direction) will not transport the product web without slip and will therefore also not represent a dead time in the sense of the transport of the extension. This partial wrap-around amount can then be added approximately to the web length of the preceding web section (addition).

The disclosure is based on the measure of performing the actuation of a second product-web section, which is separated from a first product-web section by a delay section, by way of a second actuating command (in particular, in the context of pilot control) which results from a regulation output value for the regulation of the tension in the first product-web section and additionally with the use of a time delay element, in particular a dead time element, an approximation of a dead time element, or of a $PT_1, \ldots, PT_n$ element. The actuation of a product-web section is to be understood to be the actuation of an actuator for controlling/regulating the web stress in the relevant product-web section. The actuating command preferably influences the rotational speed of a clamping point, which delimits the product-web section, as actuator, but other actuators, such as pressure-loaded rolls, are also known, however. The infeed unit and the unwinding device can likewise be incorporated into the pilot control in the upstream direction, and the outfeed unit and the winding device can likewise be incorporated into the pilot control in the downstream direction.

Starting from an existing regulation structure, a regulation structure according to the disclosure can be obtained by insertion of a time delay element into the generation of the actuating command for the actuator which influences the web tension in the second product-web section. The disclosure can be implemented particularly simply in practice. In particular, it can be added to regulation structures, as are known in the prior art and have been described in the introduction. Here, in the context of this disclosure, reference is made expressly to the regulation structures according to DE 10 2008 056 132 A1 and DE 10 2009 016 206 A1. The combination of the present disclosure with these regulation structures is stated expressly as a particularly preferred embodiment of the disclosure. As a result, in addition to the decoupling of the second product-web section, decoupling of further sections can take place. A combination with a regulation structure according to the subsequently published DE 10 2011 014 074 is also particularly preferred. In this way, a location with an unchanged product-web speed can be predefined, which is advantageous, in particular, for digital printing units.

It is likewise advantageous to take the time delay into consideration in the design of the regulation by stipulation of the regulator parameters (such as proportional gain $K_P$, integral-action time $T_N$, etc.). Typically, for example, the P gain which can be achieved drops as the time delay rises. As an alternative, compensation (for example, by means of a Smith predictor) for the expected time delay can be carried out in the regulator.

A computing unit according to the disclosure, for example a control unit of a web processing machine, is set up, in particular in terms of programming technology, to carry out a method according to the disclosure.

The implementation of the disclosure in the form of software is also advantageous, since this makes particularly low costs possible, in particular if an executing computing unit is also used for further tasks and is therefore present in any case. Suitable data storage media for providing the computer program are, in particular, diskettes, hard drives, flash memories, EEPROMs, CD-ROMs, DVDs and others. A download of a program via computer networks (Internet, Intranet, etc.) is also possible.

Further advantages and refinements of the disclosure result from the description and the appended drawing.

It goes without saying that the features which are stated above and are still to be explained in the following text can be used not only in the respectively specified combination, but also in other combinations or on their own, without departing from the scope of the present disclosure.

BRIEF DESCRIPTION OF THE DRAWINGS

The disclosure is shown diagrammatically using exemplary embodiments in the drawings, and will be described in detail in the following text with reference to the drawings.

DETAILED DESCRIPTION

Figure 1:
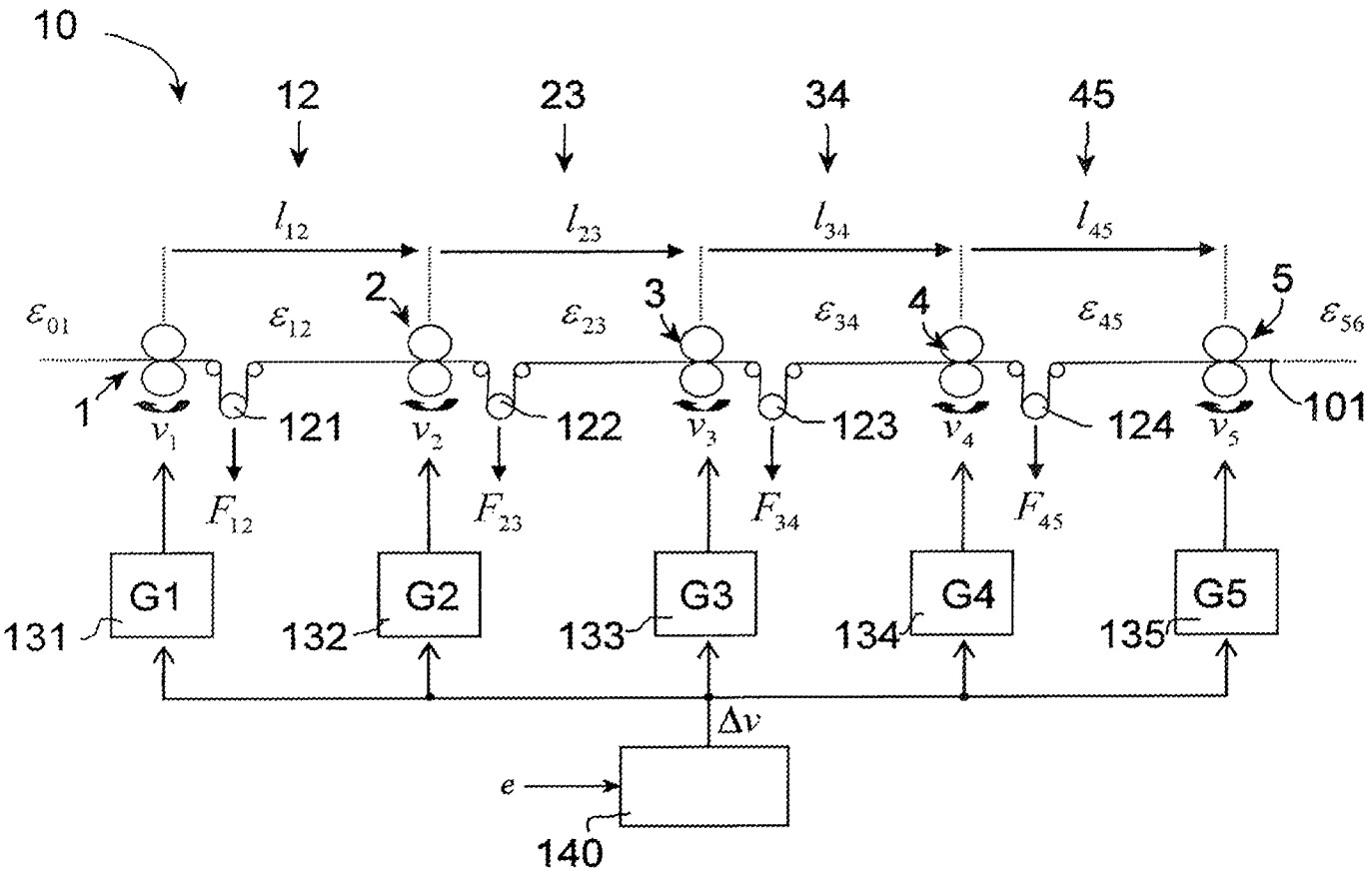
FIG. 1 shows a diagrammatic illustration of a generalized regulating structure for the decoupled regulation of the web tension for a product-web section using a printing press without a delay section.

FIG. 1 shows a generalized regulating and control structure for regulating and controlling the web tension for product-web sections in a printing press. A diagrammatic detail of a printing press 10 is shown, in which a material web 101 is transported and processed by five clamping points which are configured here as printing units 1 to 5. A product-web section is formed between in each case two adjacent clamping points. For example, one product-web section 12 is delimited by the printing units 1 and 2, one product-web section 23 is delimited by the printing units 2 and 3, one product-web section 34 is delimited by the printing units 3 and 4, and one product-web section 45 is delimited by the printing units 4 and 5. Furthermore, the printing press has web tension sensors which are configured here as load cells 121 to 124 for determining the tension (which, as mentioned, is proportional to the web stress) in the respective product-web sections. The determination of the respective web tensions can also take place via other methods than by way of measurement; for example, an alternative method is published in DE 10 2005 058 810 A1. In the illustration which is shown, the web tension is influenced by changing the circumferential speeds $v_1$ to $v_5$ of the printing units 1 to 5. In principle, the web tension can be set by means of angular adjustment, speed switching and/or limiting of the drive moment of at least one clamping point which delimits said product-web section.

The physical parameters, namely the length l, the elongation $\epsilon$ and the web stress or tension F of the individual product-web sections, are likewise specified in the figure with corresponding indices. Here, the length of a web section is to be considered to be the length of the product web which is clamped in the web section under consideration.

In order to regulate the web tension, a regulating deviation e is fed to a regulating element 140, for example a PI regulator, which calculates a regulation output value $\Delta v$ (for example, a change in rotational speed) therefrom. Said regulation output value can act via individual elements 131 to 135 with associated transfer functions G1 to G5 on the circumferential speeds $v_1$ to $v_5$. The elements 131 to 135 can be zero elements (that is to say, G=0), but also P elements, I elements, D elements, $PT_1$ elements, $PT_2$ elements, $PT_n$ elements, DT elements, $DT_2$ elements, $DT_n$ elements, etc. or any desired combinations thereof with the known associated transfer functions. The elements 131 to 135 and 140 are expediently implemented in a computing unit.

In the following text, fundamental examples are to be described for regulating the web tension in the section 34.

For the section 34, an increase in the speed $v_3$ of the front clamping point 3 brings about a reduction in the web tension and, conversely, an increase in the speed $v_4$ of the rear clamping point 4 brings about an increase in the web tension. The following regulating and decoupling strategies are known, the manipulated variable resulting as $Gi*\Delta v$:

(1) Upstream regulation: G1=0, G2=0, G3=−1, G4=0, G5=0

(2) Downstream regulation: G1=0, G2=0, G3=0, G4=1, G5=0

(3) Upstream regulation with upstream decoupling: G1=−1, G2=−1, G3=−1, G4=0, G5=0

(4) Upstream regulation with upstream and downstream decoupling: G1=−1, G2=−1, G3=−1, G4=0, G5=−PT1

(5) Downstream regulation with downstream decoupling: G1=0, G2=0, G3=0, G4=1, G5=DT1

Figure 2:
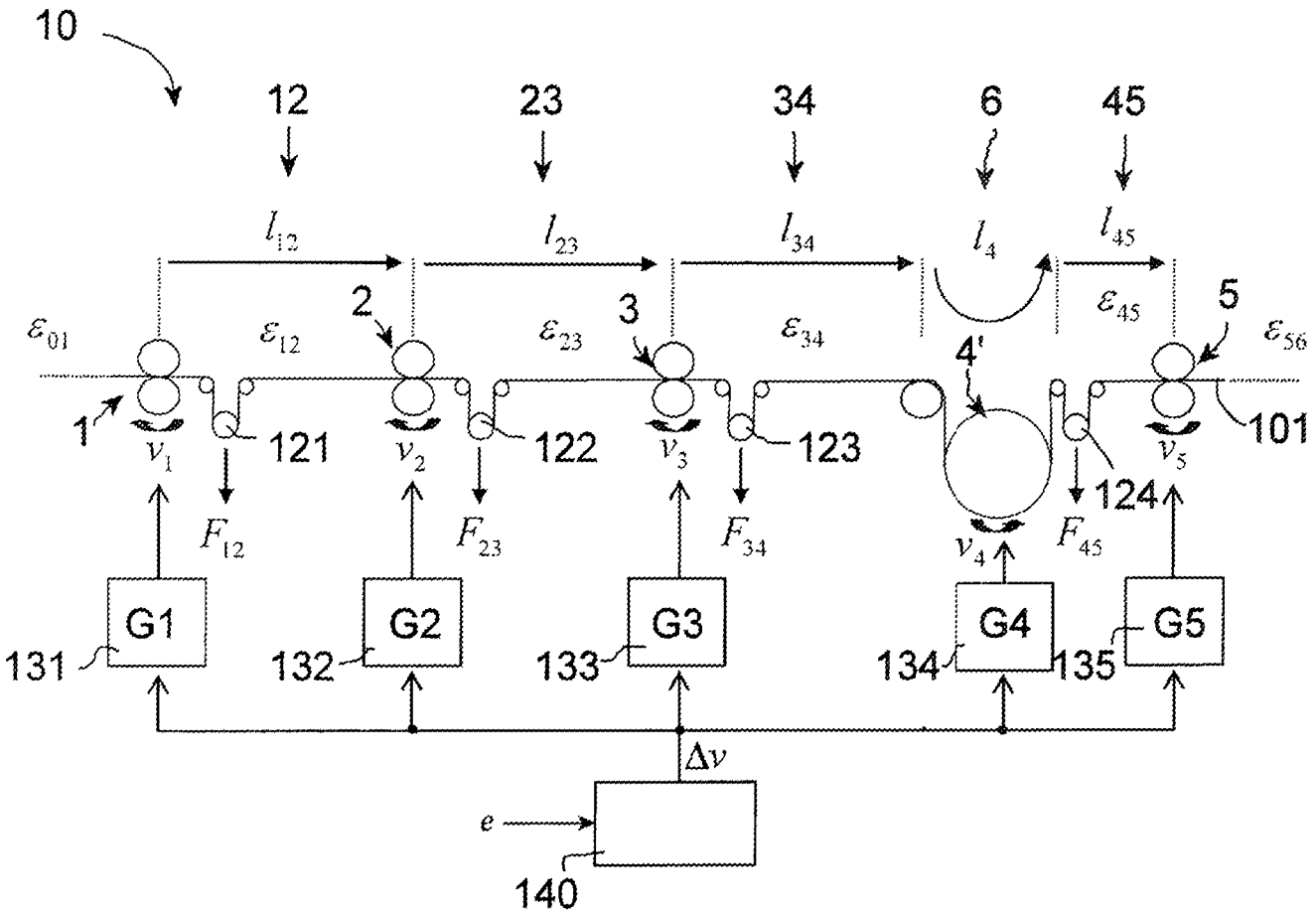
FIG. 2 shows an alternative to FIG. 1 with a delay section which is formed by a roll which is wrapped around.
Figure 3:
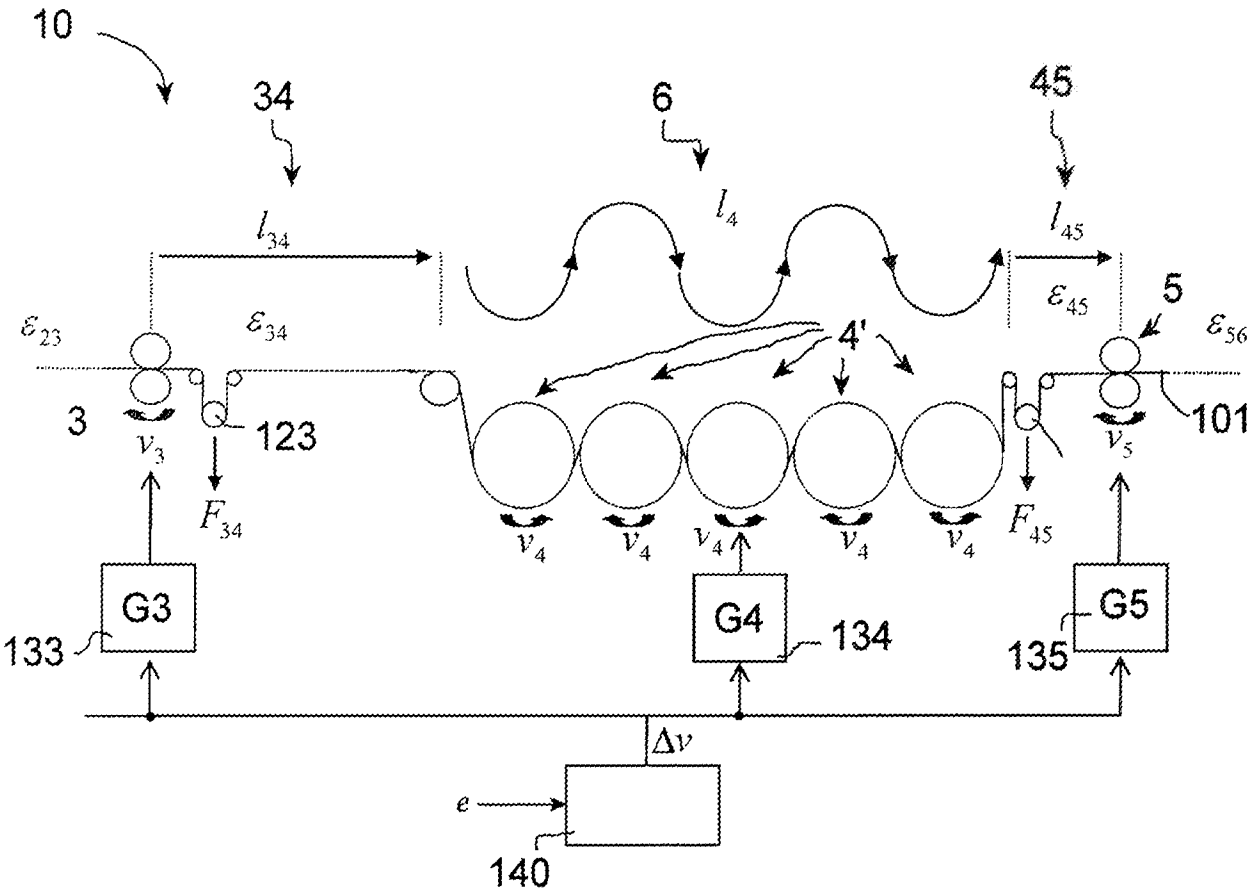
FIG. 3 shows an alternative to FIG. 1 with a delay section which is formed by a plurality of rolls which are wrapped around.

In said regulating strategies, there is no provision to take a delay section into consideration. A delay section 6 can be produced, for example, if a clamping point is configured as a roll 4' with wrap-around of the product web, for example as a drying roll, according to FIG. 2 or as a series of rolls 4' which are wrapped around according to FIG. 3. Each roll 4' is wrapped around by approximately 50% in the figure.

The delay section 6 then leads to a time delay $\Delta T$ during the imparting of a web tension change which corresponds to the running time of the product web along the wrapped-around length of the roll/rolls 4'. The length can be given by $l_4$, with the result that $\Delta T=l_4/v_4$.

The decoupling formulae explained above are therefore changed within the scope of the disclosure in such a way that, despite the time delay $\Delta T$, the web stress in the product-web sections (here, the section 45) which are separated by the delay section 6 remains decoupled from an adjustment of the web tension in the section 34. Without the time delay being taken into consideration, the use of formula (4) in the case of FIG. 2 or 3, for example, would lead to a change in the web tension $F_{45}$ in the product-web section 45.

Advantageously developed formulae result in:

(6) Upstream regulation with upstream and downstream decoupling via a delay section:

G1=−1, G2=−1, G3=−1, G4=0, G5=−PT1*ΔT

The delay element can be approximated as a dead time element, as a PTn element (n=1, 2, 3, . . . ) or can be Padé approximated.

As has been described in DE 10 2011 014 074 which is a later publication, a regulating formula can be transferred into equivalent other regulating formulae by way of simple addition or subtraction of regulating elements. For example, (5) results from (4) by way of the addition of G=1, wherein 1−PT1 is approximated as DT1.

The following thus results, for example, from (6) by way of the addition of G=1:

(7) Downstream regulation with downstream decoupling:

G1=0, G2=0, G3=0, G4=1, G5=1−PT1*ΔT.

The disclosure covers all decoupling strategies which can be derived from (6) by way of addition, subtraction, multiplication and division.

In the above example (6), the roll/rolls 4' remains/remain nonadjusted, which is usually desired. If, however, it is desired, for example, that the clamping point 5 remains nonadjusted, this could be achieved by the addition of PT1*ΔT, the result of which would be the following equivalent regulating formula:

$$G1=-1+PT1*\Delta T, G2=-1+PT1*\Delta T, G3=-1+PT1*\Delta T, G4=PT1*\Delta T, G5=0 \quad (6')$$

In this case, first of all all the clamping points upstream of the delay section would be adjusted in the same direction (G=−1+PT1*ΔT), in order to decouple the regulator intervention. The regulator intervention is then transferred in a temporally delayed manner into the section 45. For the decoupling of the section 45, the clamping point 4' is adjusted only after the delay time according to a PT1 method ($G4=\underline{PT1*\Delta T}$). In order to decouple the preceding product-web sections 34, 23 and 12 from said renewed actuating movement, the associated clamping points 1-3 are likewise adjusted after the delay time according to a PT1 method ($G=-1\underline{+PT1*\Delta T}$).

The decoupling strategies which are shown in the disclosure apply to the regulation of the tension, web stress and elongation. The actual force, actual web stress and/or actual elongation can therefore likewise be used as input variables for the regulation. Furthermore, regulation and/or pilot control by way of variables which are reconstructed by means of observers would be conceivable.

Furthermore, the control variables of the elements 131 to 135 which act on the speeds $v_1$ to $v_5$ can be combined with control variables of web tension regulation operations of further product-web sections. The above description described a regulation operation with measurement in the product-web section 34. If, in addition, there are also further web tension regulation operations, for example with measurement in the product-web sections 12, 23 and 45, the control variables thereof are added to the speeds $v_1$ to $v_5$.

What is claimed is:

1. A method for regulating a web tension in a processing machine for processing a product web, comprising:

separating a first product-web section from a second product-web section by a delay section, which includes at least one roll, at least 25% of which is wrapped around by the product web:

influencing a first web tension in the first product-web section by a first actuator and influencing a second web tension in the second product-web section by a second actuator;

defining a regulation output value to regulate the first web tension in the first product-web section;

deriving a first actuating command for the first actuator from the regulation output value;

deriving a delay element corresponding to a delay time defined as a quotient of a length of the delay section and a speed of the product web in the delay section;

deriving a second actuating command for the second actuator from the regulation output value and the delay element to delay an effect of the regulation output value on the second actuating command for the second actuator by the delay time in such a way that the second web tension in the second product-web section is decoupled from the influencing of the first web tension in the first product-web section; and driving the second actuator based on the second actuating command.

2. The method according to claim 1, wherein the delay element is a dead-time element or a proportional element with time delay or an element according to a Padéapproximation.

3. The method according to claim 1, wherein the delay section contains a plurality of rolls, each respective roll of the plurality of rolls being wrapped around by the product web on at least 25% of a circumference of the respective roll.

4. The method according to claim 3, wherein behaviors of the first web tension and the second web tension are taken into consideration during definition of the length of the delay section which is formed by one or more rolls which are wrapped around by the product web.

5. The method according to claim 1, wherein behaviors of the first web tension and the second web tension are taken into consideration during definition of the length of the delay section which is formed by one or more rolls which are wrapped around by the product web.

6. The method according to claim 1, further comprising predetermining regulator parameters for the defining of the regulation output value as a function of the delay time.

7. The method according to claim 1, further comprising predetermining regulator parameters for the defining the regulation output value as a function of the delay time if a determination of a feedback variable for the regulation takes place at a position which is separated from the first actuator by the delay section.

8. The method according to claim 1, further comprising calculating or estimating a feedback variable for the second actuating command.

9. The method according to claim 1, further comprising using at least one of a web stress and an actual elongation of the product web as input variables for the first and second actuating commands.

10. The method according to claim 1, wherein the processing machine for processing the product web is a shaftless printing press.

11. A computing unit configured to implement a method for regulating a web tension in a processing machine for processing a product web, the method including:

separating a first product-web section from a second product-web section by a delay section, which includes at least one roll, at least 25% of which is wrapped around by the product web:

influencing a first web tension in the first product-web section by a first actuator and influencing a second web tension in the second product-web section by a second actuator;

defining a regulation output value to regulate the first web tension in the first product-web section;

deriving a first actuating command for the first actuator from the regulation output value;

deriving a delay element corresponding to a delay time defined as a quotient of a length of the delay section and a speed of the product web in the delay section;

deriving a second actuating command for the second actuator from the regulation output value and the delay element to delay an effect of the regulation output value on the second actuating command for the second actuator by the delay time in such a way that the second web tension in the second product-web section is decoupled from the influencing of the first web tension in the first product-web section; and driving the at least one roll with the second actuator based on the second actuating command.

* * * * *